United States Patent [19]

Berstein et al.

[11] Patent Number: 4,542,565

[45] Date of Patent: Sep. 24, 1985

[54] ROLLING TOOL

[75] Inventors: Garri Berstein, Erkelenz; Siegfried Bagusche, Erkelenz-Lövenich, both of Fed. Rep. of Germany

[73] Assignee: Wilhelm Hegenscheidt Gesellschaft mbH, Erkelenz, Fed. Rep. of Germany

[21] Appl. No.: 618,748

[22] Filed: Jun. 8, 1984

[30] Foreign Application Priority Data

Jul. 7, 1983 [DE] Fed. Rep. of Germany ..... 3324494

[51] Int. Cl.[4] ..... B24B 39/00

[52] U.S. Cl. ..... 29/90 R

[58] Field of Search ..... 29/90 R

[56] References Cited

U.S. PATENT DOCUMENTS

| | | | |
|---|---|---|---|
| 3,320,652 | 5/1967 | Huber et al. | 29/90 R |
| 3,555,643 | 1/1971 | Koppelmann | 29/90 R |
| 3,835,517 | 9/1974 | Walters | 29/90 R |

*Primary Examiner*—Leonidas Vlachos

*Attorney, Agent, or Firm*—Arthur B. Colvin

[57] ABSTRACT

A planishing tool includes an axially slideable adjustment collar. When the collar is retracted to an inactive or adjustment position it may be rotated to vary the operating diameters of the planishing rollers. When the collar is released, the parts are locked against rotation relative to the mandrel in an active or operative position.

7 Claims, 2 Drawing Figures

ROLLING TOOL

Figure 1:
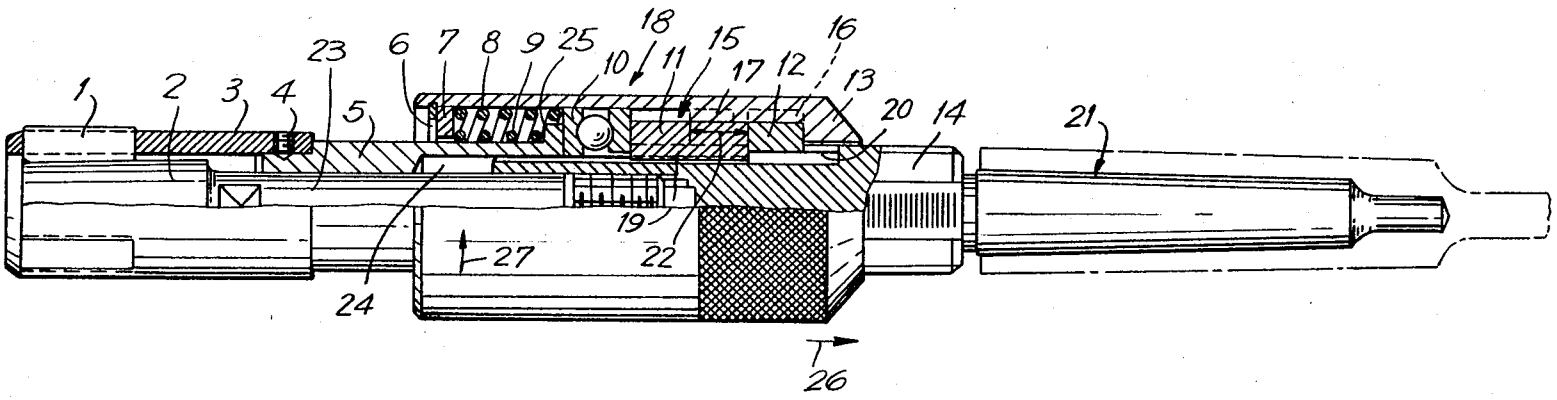

This invention relates to a rolling tool for planishing cylindrical surfaces with planishing rollers which bear against a support cone in planetary fashion are separated by a cage arranged coaxially with the support cone, the support cone and cage being rotatable relative to each other and being relatively axially displaceable for adjustment. At least one axially displaceable part of the cone assembly is supported in a direction opposite to the feed direction of the tool on a threaded nut arranged on a slotted threaded portion of a mandrel, the nut being positively connected with an adjusting sleeve coaxial with the mandrel via driver elements.

Rolling tools of the described kind are in use and give satisfactory results. Diameter variations of the nominal diameters of the work to be machined can be adequately compensated by adjustment of the tool. This occurs by shifting the support cone and the cage separating the rolling rollers axially relative to each other. Owing to this there occurs a corresponding radial movement of the rolling rollers, which are thereby brought to a different working diameter position. The axial displacement of the axially movable part occurs by a change of position of said nut on the mandrel. To this end the nut has at its outer circumference a longitudinal slot, which cooperates with a corresponding counter-piece of an adjusting sleeve spanning the nut. By rotation of the adjusting sleeve, the nut is rotated as well, and thereby its axial position is changed. Thereby also the axial position of the axially displaceable part is changed, whereby the diameter adjustment is brought about.

In order that no unintended displacement can occur after the diameter has been set, the nut has on its rear end face a spur toothing. A socket with corresponding spur toothing directed toward the toothing of the nut, with at least one tooth, but preferably four teeth in cross arrangement, is fitted from behind on the threaded portion of the mandrel. The inner bore of this socket has a cotter or a fitting key, which engages in the longitudinal slot of the threaded part of the mandrel. Thereby the socket is guided on said threaded part non-rotationally but axially displaceable. When the nut has reached a desired axial position, the teeth of the socket are inserted into the teeth of the nut, and from behind a lock nut is screwed behind the socket, so that the threaded nut, the socket and the lock nut abut and the threaded nut can no longer be rotated, As the adjusting sleeve engages in the outer longitudinal slot of the threaded nut, it too, of course, can no longer be rotated.

Now if a diameter adjustment is to be made, first said lock nut must be unscrewed and the socket teeth disengaged. Thereafter, by rotating the adjusting sleeve, the threaded nut can be rotated and the diameter adjustment thus made. After completed diameter adjustment, the socket teeth must again be brought in engagement with the threaded nut and the lock nut screwed on.

It is the object of the invention to provide an improved tool of the type described wherein a faster and simpler diameter adjustment is possible without loss of adjustment security, and at the same time the construction cost is reduced.

According to the invention, this problem is solved in that between the cone assembly and the threaded nut at least one latch socket is arranged, which has, in circumferential direction, seating areas for the positively acting driver elements of the adjusting sleeve and whose inner bore has a longitudinal wedge, key or spine engaging in the longitudinal slot of the threaded portion of the mandrel, the adjusting sleeve being axially displaceable by at least an amount such that the driver elements no longer positively engage in the latch socket. By the described arrangement it becomes possible in simplest manner to fix the adjusting sleeve, threaded nut, latch socket and threaded part by reciprocal engagement via the described driver elements nonrotationally relative to each other, without need for a lock nut. Thus at least the lock nut can be omitted and at the same time the described complicated spur toothing can be omitted. By the special arrangement of the latch socket, which lies in front of the threaded nut, it is possible to release the mutual connection of the parts by simple retraction of the adjusting sleeve, because thereby the positive union with the latch socket is released, so that the reciprocal connection is released and the threaded nut can be rotated by simple rotational movement of the adjusting sleeve.

When the desired adjustment is reached, the adjusting sleeve is pushed forward again and the non-rotational connection of the parts is restored. All that is required for the adjustment, therefore, is a short retraction and rotation of the adjusting sleeve. After the desired position has been reached, the adjusting sleeve is pushed or permitted to spring forward again and the adjusted position is fixed absolutely reliably. Unscrewing and screwing home of lock nuts is not necessary and also the lock nut itself is superfluous. Spur toothings can be omitted.

According to a variant of the invention for the machining of bores it is provided that an axial bearing is arranged between the axially displaceable part and the latch socket. The rotational load on the latch socket is thereby minimized.

Another variant of the invention provides that in feed direction before the latch socket a compression spring is provided which presses the latch socket against the threaded nut directly or by way of displaceable elements lying therebetween. The spreading (expanding) action of said spring always provides for a correct abutment and positioning the respective structural elements.

According to another variant of the invention it is provided that the adjusting sleeve has, arranged before the threaded nut, at least one axially acting compression spring, which takes support, on the one hand, on the adjusting sleeve and, on the other, on the threaded nut or on such structural parts as are supported by the nut, the adjusting sleeve being held in abutment on the other side of the nut by the compression spring against the nut by way of an abutment collar. Thereby the desired fixed position can be entered into automatically by the described compression spring after simply letting go of the adjusting sleeve. Intentional pushing forward of the adjusting sleeve after completed adjustment is unnecessary.

Still another variant of the invention provides that the spring acts simultaneously on the axially displaceable part and on the adjusting sleeve. Thereby, on the one hand, the desired spring load on the adjusting sleeve is obtained and, on the other, simultaneously the axially displaceable part is kept under spring prestress in a manner known in itself, so that the tool with its planishing rollers disengages during retraction in known manner and is automatically pushed by said spring to the set working diameter after leaving the rolled work surface. In the present instance the spring fulfills both functions.

Further it is proposed according to a variant of the invention that at least the longitudinal slots at the outer circumference of the latch socket and threaded nut and the appertaining longitudinal spline of the adjusting sleeve are formed as external spurs and, for the nut and adjusting sleeve, as tooth gap and corresponding tooth. This design is easy to manufacture and results in favorable engagement conditions.

Lastly it is provided according to a variant of the invention that the latch socket, threaded nut and adjusting sleeve can be connected together positively through corresponding longitudinal bores by way of at least one axial pin, the latch socket having several corresponding longitudinal bores distributed in circumferential direction. This configuration of the individual elements is especially favorable in tools for rolling cylindrical outer surfaces.

The invention will now be described more specifically with reference to the embodiments illustrated in the drawings.

Figure 2:
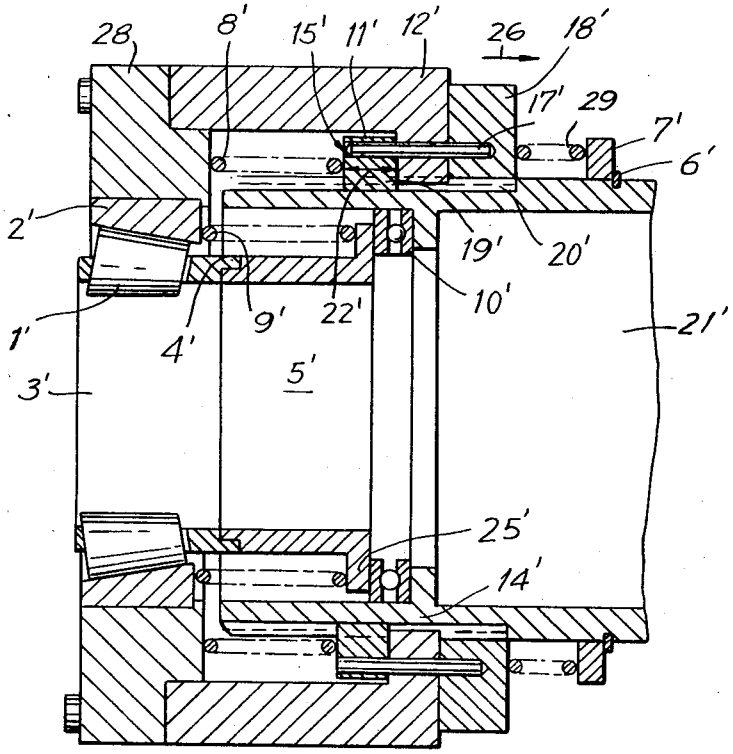

FIG. 1 shows an inside planishing tool in longitudinal section and side view;

FIG. 2 an outside planishing tool in longitudinal section.

The tools according to FIGS. 1 and 2 do not differ in principle. The simple fact is that one tool is the kinematic reversal of the other tool, and there are no differences in principle of operation between an inside planishing tool and an outside planishing tool of the kind shown.

An inside planishing tool according to FIG. 1 consists essentially of a mandrel 21, to which is contiguous in axial direction a threaded portion 14. Threaded portion 14 has an axially directed slot 20. At the front end of the threaded portion 14 a shank 23 is inserted, the free end of which is formed as a support cone 2. Bearing against the support cone 2 and revolving in planetary fashion thereabout are several planishing rollers 1, which are separated in the usual known manner by a cage 3 concentric with the support cone 2. The cage 3 is connected by way of radial stud 4 with an axially displaceable part 5 which projects beyond the cage. This axially displaceable part 5 is guided for rotation on shank 23 and is axially displaceable relative thereto. The surface of part 5 remote from the cone 2 is formed with an axial bore 24 of a diameter such that the threaded portion 14 can be inserted axially thereinto. Part 5 includes a collar 25, the rear flat surface of which bears against an axial bearing 10. Bearing 10, in turn, bears against the front end-face of a latch socket 11, the rear end-face of which in turn applies against the front end-face of a threaded nut 12. The latch socket 11 is axially displaceable along the threaded portion 14 and engages by an inner longitudinal wedge, key or spline 19 into the longitudinal slot 20 of the threaded portion 14, whereby the latch socket 11 is secured against rotation about the mandrel.

The outer circumference the latch socket 11 is formed with longitudinal slots 15 uniformly angularly spaced apart. On its outer circumference side the contiguous nut 12 has at least one longitudinal slot 16, the dimensions of slots 15 and 16 being such that when longitudinal spline or wedge 17 is disposed in spanning relation of the slots the nut and the socket are non-rotatably connected.

The longitudinal spline 17 is arranged on the inside of an adjusting sleeve 18 and engages into slot 15 of latch socket 11 in axial direction only by a partial amount 22. Thereby a sufficient torque transmitting relation is ensured, and the axial displacement path for decoupling the spline from the socket can be kept short.

In the active or torque transmitting position, the collar 13 of the adjusting sleeve 18 abuts against the rear flat surface of nut 12. In this position the desired torque transmission is established and the set diameter position is thereby fixed.

In feed direction forwardly, the adjusting sleeve 18 embraces the assembly described in front of the collar 25 of the axially displaceable part 5. At the front opening, the adjusting sleeve 18 terminates with a snap ring 6, which is followed inwardly by a stop disk 7. Between the front plane face of collar 25 and the back plane face of disk 7 a coil compression spring 9 is arranged. Furthermore, concentric with spring 9, an additional coil compression spring 8 is provided, which also abuts against the back face of stop disk 7 on the one hand and take support on the axial bearing 10, on the other hand. Due to spring 8, the stop collar 13 in the normal or active position, always engages the back end-face of nut 12. Due to spring 9, the rear plane face of collar 25 in the normal or active position engages the axial bearing 10. Hence all structural parts occupy a clearly defined position.

However, in particular in the case of relatively large tools, it is readily possible to combine the springs 8 and 9 as one spring 9 such that when retracting the tool from the finished machined bore the planishing rollers 1 can easily slide forward in the direction of a smaller diameter portion of the cone. After the tool has left the finished machined bore, spring 9 pushes the axially displaceable part 5 and hence cage 3 and the planishing rollers 1 back into the original position, which is reached after abutment of the rear plane face of collar 25 against the axial bearing 10.

For diameter adjustment, the adjusting sleeve 18 is pulled back in the direction of arrow 26 by the amount 22, to an inactive or adjustment position so that spline 17 is no longer in engagement with slot 15. However, spline 17 continues to be keyed to slot 16 of nut 12. After the described retraction of the adjusting sleeve 18, the latter can be turned for example in the direction of arrow 27, whereby also nut 12 is turned accordingly. Thereby nut 12 changes its axial position on the threaded portion 14, whereby in conjunction with the structural parts supported by nut 12 the desired diameter variation of the enveloping circle of the planishing rollers 1 is brought about. The desired position having been reached, it suffices to let go of the adjusting sleeve 18. It is then pushed forward again by the force of spring 8 and optionally of spring 9 in a direction opposite to arrow 26, owing to which spline 17 again engages in one of the slots 15 of latch socket 11, whereby the newly set diameter position is fixed. The tool can now be used in the manner known in the art.

The operation of a tool according to FIG. 2 is similar in principle. A tool according to FIG. 2 is simply the kinematic reversal of a tool according to FIG. 1, and in the ensuing description functionally corresponding parts are accorded like reference numerals. For the realization of the same design principle, therefore, some structural parts are modified in structural adaptation to external machining.

The planishing rollers 1' are disposed in planetary fashion on a support cone 2' which embraces them on the outside. The support cone 2' is carried by a flange 28 concentric to the tool axis, flange 28 being fastened at the front end of a nut 12'. Nut 12' is arranged on the threaded portion 14', which has a longitudinal slot 20', the threaded portion 14' being extended rearwardly as mandrel 21'. This mandrel 21' may be of any design and is not shown in detail.

In feed direction in front of nut 12' a latch socket 11' is arranged for longitudinal displacement, which by a longitudinal spline or key 19' engages in slot 20' and is thereby secured against rotation.

In feed direction behind nut 12', an adjusting sleeve 18' is mounted displaceably and rotatably on mandrel 21' or specifically over the appertaining threaded portion 14'. In feed direction behind the adjusting sleeve 18' and spaced therefrom, a snap ring 6' with a stop disk 7' therebefore is provided on the mandrel 21. A compressuon spring 29 is disposed between adjusting sleeve 18' and stop disk 7'.

The adjusting sleeve 18' has at least one axially extending pin 17', which passes through a corresponding longitudinal bore in nut 12' and engages on the other side of nut 12' into one of several uniformly angularly spaced longitudinal bores 15' of adjusting sleeve 11'. By means of this pin 17', therefore, the adjusting sleeve 18', nut 12' and latch socket 11' are connected together, with the longitudinal spline or key 19' providing, in the described state, that said three parts cannot rotate about the mandrel and at the same time the thread of nut 12' provides that at least the nut 12' cannot shift axially. Thus a secure fixation of nut 12' in the position once set is achieved. Due to the compression spring 29, the adjusting sleeve 18' always applies against the back of nut 12'. A corresponding abutment of the latch socket 11' on the other side of nut 12' is provided by the coil compression spring 8'.

Also in the above described design the planishing rollers 1' are guided in a suitable manner known in itself in a cage 3' separating them, which is connected, for example by way of stud 4', with a likewise axially displaceable part 5', which by way of a collar 25' takes support on an axial bearing 10' likewise in known manner. A spring 9' provides for the necessary abutment and for the free mobility of the planishing rollers 1' in axial direction during retraction of the tool. This aspect of the design is known in itself.

For diameter adjustment of the tool according to FIG. 2, the adjusting sleeve 18' must be retracted counter to the force of compression spring 29 in the direction of arrow 26 by the amount 22', for a separation from the latch socket 11' to take place. In said retracted position the adjusting sleeve 18' can now be rotated to carry out the diameter adjustment and in so doing it takes along nut 12' by way of the still existing positive coupling through pin 17', whereby the necessary displacement is achieved. After the desired adjusted position has been reached, it suffices to release the adjusting sleeve 18', with pin 17' aligned with one of the bores 15' whereby the compressed spring 29 returns sleeve 18' in a direction opposite arrow 26 recoupling the parts non-rotatably in the active or operative position.

Having thus described the invention and illustrated its use, what is claimed as new and is desired to be secured by Letters Patent in the United States is:

1. A rolling tool for planishing cylindrical surfaces, of the type which comprises a support cone assembly, a cage axially displaceable and rotatably mounted on said cone assembly and a series of rollers disposed within said cage and bearing against said cone, said tool including apparatus for varying the axial position of said cone assembly relative to said cage, said apparatus comprising a mandrel having a threaded porton, a stop nut rotatably mounted on said threaded portion of said mandrel, a latch socket abutting said nut and axially moveably mounted on said mandrel between said nut and said cone assembly, an axially directed slot formed in said mandrel, key means spanning the space between said socket and said slot for non-rotatably coupling said socket and said mandrel, axially directed slot means on said socket, axially directed slot means on said nut, the slot means of said nut and said socket being shiftable into axial alignment responsive to rotation of said nut about said threaded portion of said mandrel, an adjustment sleeve encompassing said socket and said nut, said adjustment sleeve being axially movably mounted on said mandrel, a spline member on said sleeve, said spline member being shiftable with said sleeve relative to said nut and socket between an active position whereat portions of said spline lie within said slot means of said nut and said socket to thereby couple said nut and socket in torque transmitting relation and an adjustment position whereat said spline means of said sleeve is engaged with the slot means of said nut and cleared from said slot means of said socket, said nut, in said adjustment position of said sleeve being rotatable with said sleeve relative to said threaded portion of said mandrel and said socket to thereby shift the axial position of said nut along said mandrel.

2. Apparatus in accordance with claim 1 and including spring means reacting against said sleeve for biasing said sleeve to said active position.

3. Apparatus in accordance with claim 2 wherein said socket includes a plurality of said slot means, said spline of said adjustment means being selectively engagable with one of said plurality of slot means of said socket.

4. Apparatus in accordance with claim 2 and including a bearing member interposed between said support cone assembly and said socket.

5. Apparatus in accordance with claim 2 wherein said socket is yieldably urged against said nut.

6. Apparatus in accordance with claim 2 wherein said spline comprises an axially directed pin member, and said slot means of said socket and said nut comprise axially directed bores in radial alignment with said pin.

7. Apparatus in accordance with claim 2 wherein said spring means is biased between said sleeve and said cage.

* * * * *